US007823334B2

(12) United States Patent
Jolitz

(10) Patent No.: US 7,823,334 B2
(45) **Date of Patent: *Nov. 2, 2010**

(54) RIDGE CAP ROOFING PRODUCT

(75) Inventor: Randal J. Jolitz, Joplin, MO (US)

(73) Assignee: Tamko Building Products, Inc., Joplin, MO (US)

( * ) Notice: Subject to any disclaimer, the term of this patent is extended or adjusted under 35 U.S.C. 154(b) by 781 days.

This patent is subject to a terminal disclaimer.

(21) Appl. No.: 11/530,094

(22) Filed: Sep. 8, 2006

(65) Prior Publication Data

US 2008/0078132 A1 Apr. 3, 2008

Related U.S. Application Data

(63) Continuation of application No. 10/757,230, filed on Jan. 14, 2004, now Pat. No. 7,178,294.

(51) Int. Cl.
*E04B 7/02* (2006.01)

(52) U.S. Cl. ..... 52/43; 52/42; 52/198; 52/276; 52/278; 52/519; 52/90.1

(58) Field of Classification Search ..... 52/41–43, 52/518–560, 57, 199, 90.1–90.2, 91.1–91.3, 52/92.1–92.3
See application file for complete search history.

(56) References Cited

U.S. PATENT DOCUMENTS 1,358,113 A * 11/1920 Robertson ..... 52/559
1,470,331 A 10/1923 Saul
1,471,396 A 10/1923 Griswold
3,291,298 A 12/1966 McCue
3,913,294 A 10/1975 Freiborg
3,943,677 A * 3/1976 Carothers ..... 52/309.4
4,015,374 A 4/1977 Epstein et al.
4,024,685 A 5/1977 Aarons
4,185,436 A 1/1980 Vallee
4,218,857 A 8/1980 Vallee
4,434,589 A 3/1984 Freiborg
4,439,955 A 4/1984 Freiborg
4,907,499 A * 3/1990 James ..... 454/365
5,094,042 A 3/1992 Freiborg
5,295,340 A * 3/1994 Collins ..... 52/518
5,319,898 A 6/1994 Freiborg
5,375,388 A * 12/1994 Poplin ..... 52/560
5,471,801 A * 12/1995 Kupczyk et al. ..... 52/57
5,816,014 A * 10/1998 Tzeng et al. ..... 52/745.19
6,070,384 A 6/2000 Chich (Continued)

*Primary Examiner*—Jeanette Chapman
(74) *Attorney, Agent, or Firm*—Husch Blackwell LLP

(57) ABSTRACT

The present invention generally encompasses a ridge cap roofing product that is formed from a composite material. The ridge cap has a cross section that is generally in the shape of an inverted V with a rounded apex and includes a front section and a back section. The front section has a straight lower edge. The back section has a lowered edge that tapers both upward and inward. The tapered shape of the ridge cap's back section insures that installed ridge caps lie flat and that a covered ridge or hip does not have a saw tooth appearance. The ridge cap of the present invention is somewhat flexible so that it can be used with roofs that have a range of pitches. In one embodiment, the top surface of the ridge cap's front section is textured or contoured so that it simulates certain conventional shingles.

18 Claims, 1 Drawing Sheet

U.S. PATENT DOCUMENTS 6,120,913 A * 9/2000 Kluttz et al. ..... 428/521
6,125,602 A * 10/2000 Freiborg et al. ..... 52/560
6,182,400 B1 * 2/2001 Freiborg et al. ..... 52/57
6,351,913 B1 3/2002 Freiborg et al.
6,530,189 B2 * 3/2003 Freshwater et al. ..... 52/553
6,725,609 B2 4/2004 Freiborg et al.

* cited by examiner

RIDGE CAP ROOFING PRODUCT

CROSS-REFERENCE TO RELATED APPLICATIONS

This application is a continuation of and claims priority to application Ser. No. 10/757,230, filed Jan 14, 2004 entitled RIDGE CAP ROOFING PRODUCT, now U.S. Pat. No. 7,178,294, which application is hereby incorporated by reference to the extent permitted by law.

STATEMENT REGARDING FEDERALLY SPONSORED RESEARCH OR DEVELOPMENT

Not applicable.

BACKGROUND OF THE INVENTION

The present invention relates to a roofing product. More specifically, the present invention provides a composite ridge cap that includes a textured or contoured front portion having straight lower edges and a smooth back portion having lower edges that taper upward and inward.

Ridge caps are roofing shingles that are specifically designed to cover the ridges, hips and, occasionally, the rakes of a roof. Generally, ridge caps are installed after other conventionally-shaped shingles have been installed on a roof. The ridge caps are installed over the final courses of conventionally-shaped shingles, which, along with the height of the associated ridges or hips, causes the ridge caps to be one of the most visible components of a roofing system.

A variety of ridge caps exist in the prior art. For example, the prior art includes a number of foldable ridge caps. These caps are manufactured and shipped in a flat configuration and, thereafter, the caps are bent or folded into shape during installation. Unfortunately, foldable ridge caps have some limitations. First, because they must be bent or folded into shape, foldable ridge caps require a relatively significant amount of time to install. Second, foldable ridge caps have a tendency to crack at the fold lines and curl at the edges, and, therefore, these caps have a relatively high failure rate when compared to conventionally-shaped shingles.

U.S. Pat. No. 5,295,340 provides an example of another type of prior art ridge cap. This patent discloses a preformed shingle unit for covering the hip, ridge and rake portions of an asphalt roof. The unit includes a tapered substrate that is permanently bonded to a protective top cover, sheet or panel. The top cover is configured to simulate a wood shake shingle. Although this unit purportedly avoids the limitations of folded ridge caps, it has its own drawbacks. For example, the unit is rigid so that if a roof pitch is not perfect, then the unit will not conform to the roof. Additionally, because of the many steps required, the unit is relatively difficult to manufacture. Also, the shape of the unit causes the covered hip or ridge to have an unattractive saw tooth appearance.

SUMMARY OF THE INVENTION

In order to overcome the above-stated problems, the present invention generally provides a ridge cap roofing product that is formed from a composite material. The ridge cap of the present invention has a cross section that is generally in the shape of an inverted V with a rounded apex and includes a front section and a back section. The front section has straight or horizontal lower edges. The back section has lower edges that taper both upward and inward.

The ridge caps are installed in a partially overlapping fashion. More specifically, the ridge caps are positioned so that the front section of an overlying ridge cap covers the back section of an underlying ridge cap. The tapered shape of the ridge cap's back section insures that installed ridge caps lie flat and that a covered ridge or hip does not have a saw tooth appearance.

When installation is complete, only the front sections of the ridge caps are visible. Thus, in one embodiment, the top surface of the ridge cap's front section is textured or contoured so that it simulates certain conventional shingles.

The ridge cap of the present invention is somewhat flexible so that it can be used even if a roof pitch is not perfect (e.g. 12½:12 instead of 12:12). Stated differently, the ridge cap may be used with roofs that have a range of pitches.

Additional advantages and novel features of the present invention will in part be set forth in the description that follows or become apparent to those who consider the attached figures or practice the invention.

BRIEF DESCRIPTION OF THE SEVERAL VIEWS OF THE DRAWINGS

In the accompanying drawings, which form a part of the specification and are to be read in conjunction therewith and in which like reference numerals are employed to indicate like parts in the various views.

DETAILED DESCRIPTION OF THE INVENTION

The present invention provides a ridge cap roofing product that is formed from a composite material. The ridge cap includes a back section having tapered lower edges so that when a number of ridge caps are installed in a partially overlapping fashion the covered ridge or hip will not have a sawtooth appearance. Moreover, the visible portion of the ridge cap's top surface may be textured or contoured to simulate the look of a conventional shingle. Also, the ridge cap is somewhat flexible so that it can be used on roofs that have a variety of pitches.

Figure 1:
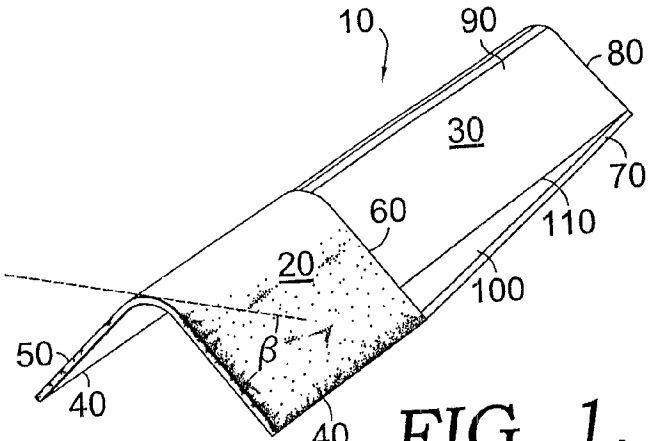
FIG. 1 is a perspective view of one embodiment of the present invention.

Turning now to FIG. 1, a ridge cap according to one embodiment of the present invention is generally referred to by the numeral 10. Ridge cap 10 includes two sections, a front section 20 and a back section 30.

Front section 20 has a cross section that is generally in the shape of an inverted V with a rounded apex. Front section 20 is defined by two horizontal side edges 40, a front edge 50 and a vertical transition edge 60. Side edges 40 are generally equal in length, are generally parallel to each other, and are generally perpendicular to both front edge 50 and vertical transition edge 60. Front edge 50 and vertical transition edge 60 are generally equal in length and are generally parallel to each other. Thus, if front section 20 were pressed flat, it would have a rectangular shape. In a preferred embodiment, the length of side edges 40 is 8 inches and the length of front edge 50 and vertical transition edge 60 is 12 inches.

Back section 30, which also has a cross section that is generally in the shape of an inverted V with a rounded apex, is defined by two side edges 70 (only one side edge 70 is shown in the figures), vertical transition edge 60, and back edge 80. Vertical transition edge 60 is generally parallel to back edge 80 and has a longer length (i.e. back edge 80 is shorter than vertical transition edge 60). Each side edge 70 tapers upward and inward thereby connecting to one end of vertical transition edge 60 and one end of back edge 80. Side edges 70 are generally equal in length. Thus, back section 30 would have a generally trapezoidal shape if pressed flat. In a preferred embodiment, the length of side edges 70 is approximately 10¼ inches and the length of back edge 80 is 9 inches.

Back section 30 may be divided into central portion 90 and tapered portion 100. Central portion 90 is defined by vertical transition edge 60, horizontal transition lines 110 (only one horizontal transition line 110 is shown in the figures), and back edge 80. Horizontal transition lines 110 are generally equal in length, are generally parallel with each other, and generally perpendicular to vertical transition edge 60 and back edge 80. Central portion 90 would be rectangular if pressed flat. In a preferred embodiment, the length of horizontal transition lines 110 is 10 inches.

Tapered portion 100 of back section 30 extends away from central portion 90 at horizontal transition lines 110. Tapered portions 100 are defined by vertical transition edge 60, horizontal transition lines 110, and side edges 70. As stated previously, horizontal transition lines 110 are generally perpendicular to vertical transition edge 60. However, side edges 70 are not perpendicular to vertical transition edge 60 or parallel to horizontal transition lines 110. Instead, each side edge 70 tapers upward and inward as it proceeds away from the end of vertical transition edge 60 and toward the end of back edge 80. Thus, tapered portions 100 have a generally triangular shape.

Continuing with FIG. 1, front section 20 and central portion 90 have similar inverted, rounded V shapes (except that the length of central portion 90 decreases from vertical transition edge 60 to back edge 80 due to the taper of side edges 70). Thus, these parts have the same general slope or angle when proceeding from the rounded apex and to either side edge 40 or horizontal transition edge 110, which is denominated β in FIG. 1. In a preferred embodiment, the angle or slope (β) of front section 20 and central portion 90 is approximately 45 degrees.

Additionally, front section 20 and central portion 90 have a generally consistent thickness In a preferred embodiment, the thickness of front section 20 and central portion 90 is approximately ¼ inches.

Tapered portion 100 does not have a generally consistent thickness. Instead, the thickness of tapered portion 100 decreases from horizontal transition line 110, where the thickness is approximately equal to the thickness of central portion 90, to side edge 70. Moreover, the change in thickness causes the angle or slope of the exterior or upper surface of tapered portion 100 to be slightly greater than the slope of front section 20 and central portion 90.

Figure 2:
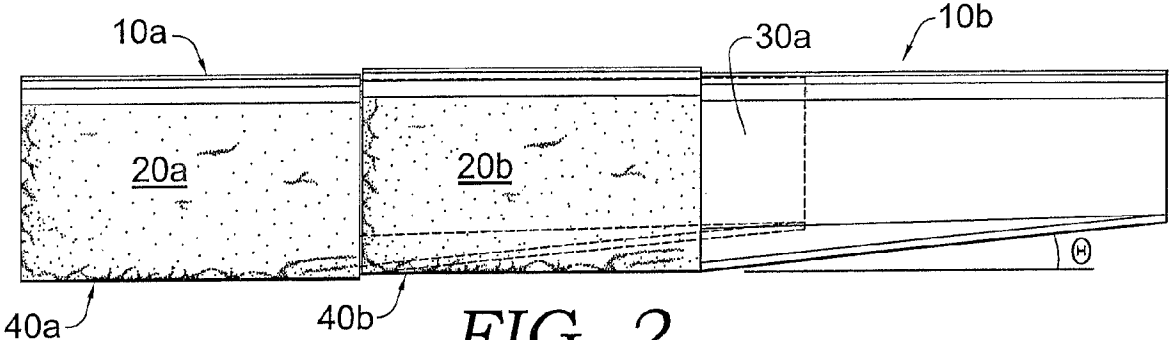
FIG. 2 is a side view of two ridge caps of the present invention positioned so that they are partially overlapping and with the overlapped portion of one ridge cap shown in dashed lines.

FIG. 2 shows two ridge caps 10*a* and 10*b* positioned so that they partially overlap, which is the position the ridge caps will be in when they are installed. From this figure it is clear that when a number of the ridge caps are installed, the front sections of the ridge caps will be visible, such as front section 20*a*, and the back section of the ridge cap will be covered, such as back section 30*a* (which is shown in dashed lines). In one embodiment, the ridge caps of the present invention are intended to simulate conventional shingles, such as a slate shingle, a tile shingle, or an asphalt shingle, and, therefore, the top surface of front section 20 is textured or contoured. Because they are covered, there is no need for the top surface of the back sections 30 to have texture so this surface may be left smooth, although it is within the scope of this invention for the top surface of back section 30 to have texture as well. In addition, it is clear from FIG. 2 that when a number of the ridge caps are installed so that only the front sections are visible, the lower edges 40*a* and 40*b* of the ridge caps are oriented in a generally straight line.

As stated above, each tapered portion 100 has a generally triangular shape when viewed from the side, with side edge 70 tapering upward and inward as it proceeds away from one end of vertical transition edge 60 and toward one end of back edge 80. As seen in FIG. 2, the side edges of underlying ridge cap 10*a* has a tapered angle θ that is sufficient to prevent the back section of ridge cap 10*a* from being visible when ridge cap 10*b* is installed in a partially overlapping position. In a preferred embodiment, the angle θ is approximately 4 degrees.

Moreover, ridge cap 10 is a composite product that is slightly flexible so that it may conform to a range of roof pitches. As stated above, in a preferred embodiment, the angle β (FIG. 1) is 45 degrees, which would conform to a roof with a pitch of 12:12. Because of its flexibility, however, the preferred embodiment may conform to slightly larger or slightly smaller pitches. Thus, if a roof has a 11½:12 or 12½:12 pitch instead of a 12:12 pitch as intended, then ridge cap 10 may still be utilized without concern that either a gap will exist between the apex of the ridge cap and the ridge or between the side edges 40 and 70 and the underlying shingles.

As will be discussed below, ridge cap 10 is installed so that it overlaps the shingles already installed on the roof. The shingles or the method by which they are installed may slightly change the effective pitch of the roof. For example, the shingles may be installed so that they stop short of the ridge instead of all the way up to the ridge or the shingles may not have a consistent thickness. Because it is flexible, ridge cap 10 will adapt to either situation and conform to the ridge or hip and the shingles already installed on the roof.

Figure 3:
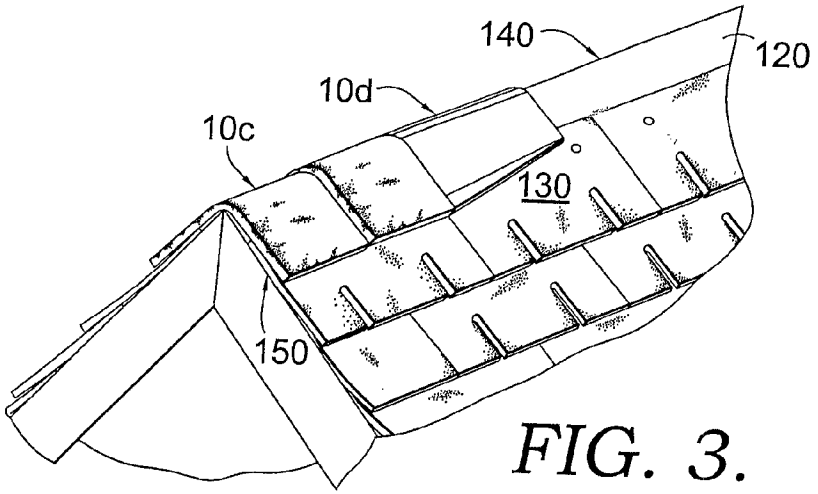
FIG. 3 is a perspective view of a cut away portion of a roof that is covered by a roofing system that includes two ridge caps according to one embodiment of the present invention that are installed at the ridge of the roof and multiple courses of shingles that are installed on the surface of the roof.

Referring now to FIG. 3, as stated above, ridge caps 10 generally are installed after a roof is covered in shingles. Typically, a roofer will begin installing a roofing system by coupling a starter course (now shown) to the roof, such as roof 120, at the eaves. Thereafter, the roofer will couple partially overlapping courses of individual shingles, such as shingle 130, moving up the roof toward the ridge or hip 140.

After the shingles 130 are installed, the roofer will couple the first ridge cap 10*c* to the ridge or hip 140 at the roof edge 150. Ridge cap 10*c* may be coupled to roof 120 in a variety of ways, including through the use of nails or adhesives. After installing ridge cap 10*c*, the roofer will couple the second ridge cap 10*d* to roof 120 so that its front section overlaps the back section of ridge cap 10*c*. Thereafter, the roofer will install additional ridge caps until ridge or hip 140 is covered. It should be understood that when the roofer reaches the opposite edge of the roof from where he or she began or reaches a gable, the roofer may cut one or more ridge caps removing the back section(s) 30 and attach the cut ridge cap or caps overtop the last full ridge cap until the roof edge or gable is reached.

As stated above, in one embodiment, the ridge cap of the present invention is a composite product. Thus, ridge cap 10 may be formed from suitable materials such as, but not limited to, rubber (e.g., ground up tire rubber), polymers such as polyethylene (e.g., various grades, recycled or virgin), fillers (e.g., glass, stone, limestone), asphalt embedded mats, or tile. In a preferred embodiment, the ridge cap is formed from a composite material that is composed of at least a polymer component and a filler component. In addition, a coloring agent may be added to the mixture so that the composite product more closely resembles a particular type of shingle. For example, for a composite slate product, a gray color may be added to the mixture. Similarly, for a composite tile product, a red color may be added to the mixture.

Ridge cap 10 may be made and cut, or molded, to shape using known techniques. For example, one manner of making ridge cap 10 relies on the use of a mixer and extruder. The ingredients that are used to form the ridge cap are mixed in the mixer and then passed through the extruder to an injection-molding machine that operates to heat the mixture into a molten state. The molten mixture is then fed into one or more molds that have been cast or machined, such as by digitized molding, to have the desired shape (including any contoured shape for simulating certain types of shingles such as slate, tile or asphalt shingles). After it has cooled, the ridge cap is removed from the mold, bundled with other ridge caps, and stored for later sale and use. Of course, as is known in the field, the above-stated steps may be automated. Moreover, many other methods of making composite versions of a starter block are also within the scope of the present invention, such as those described in U.S. patent applications Ser. Nos. 10/387,823 and 10/457,728, which are incorporated herein by reference.

While particular embodiments of the invention have been shown, it will be understood, that the invention is not limited thereto, since modifications may be made by those skilled in the art, particularly in light of the foregoing teachings. Reasonable variation and modification are possible within the scope of the foregoing disclosure of the invention without departing from the spirit of the invention.

The invention claimed is:

1. A ridge cap that is manufactured from a composite material and that has a generally inverted V shape for use in a roofing system to cover a ridge or hip, said ridge cap comprising:

a front section defined by a front edge, two lower edges and a first transition edge, with each of said two lower edges perpendicular to said front edge and to said first transition edge; and a back section defined by said first transition edge, two lower edges and a back edge, with said back edge having a smaller length than said front edge and with said two back section lower edges tapering from said first transition edge to said back edge;

wherein the thickness of said tapered portions decreases from said second transition edge to said lower edges.

2. A ridge cap according to claim 1 wherein a top surface of said front section is textured.

3. A ridge cap according to claim 2 wherein said top surface is textured to simulate a slate shingle.

4. A ridge cap according to claim 2 wherein the top surface of said back section is not textured.

5. A ridge cap according to claim 1 wherein said composite material is a combination of at least a polymer component and a filler component.

6. A ridge cap according to claim 1 wherein said back section lower edges taper upward at an angle of about 4 degrees.

7. A ridge cap according to claim 1 wherein said front surface lower edge is 8 inches long and said back section lower edge is 10 inches long.

8. A ridge cap according to claim 1 wherein the slope of said ridge cap is about 45 degrees.

9. A roofing system for covering a pitched roof, said roofing system comprising:

at least one course of shingles coupled to said roof from the eaves of said roof to the ridges of said roof; and a plurality of ridge caps coupled to said ridges of said roof, said ridge caps comprising a front section defined by a front edge, two lower edges and a first transition edge, with each of said two lower edges perpendicular to said front edge and to said first transition edge;

a back section defined by said first transition edge, two lower edges and a back edge, with said back edge having a smaller length than said front edge and with said two lower edges tapering from said first transition edge to said back edge;

a central portion that is defined by part of said first transition edge, said back edge and two second transition lines, with said second transition lines generally perpendicular to said first transition edge and said back edge; and two portions of tapered thickness extending from said central portion at each of said second transition lines.

10. A roofing system according to claim 9 wherein the top surface of said ridge cap front section is textured.

11. A roofing system according to claim 10 wherein said top surface of said ridge cap front section is textured to simulate a slate shingle.

12. A roofing system according to claim 11 wherein the top surface of said ridge cap back section is not textured.

13. A roofing system according to claim 9 wherein said ridge cap is manufactured from a composite material.

14. A roofing system according to claim 13 wherein said composite material is a combination of at least a polymer component and a filler component.

15. A roofing system according to claim 9 wherein said ridge cap back section lower edges taper upward at an angle of about 4 degrees.

16. A roofing system according to claim 9 wherein said ridge cap front surface lower edge is 8 inches long and said back section lower edge is 10 inches long.

17. A roofing system according to claim 9 wherein a thickness of said ridge cap tapered portions decreases from said second transition lines to said lower edges.

18. A roofing system according to claim 9 wherein the slope of said ridge cap is about 45 degrees.

* * * * *